US008322962B2

(12) United States Patent
Lanman et al.

(10) Patent No.: US 8,322,962 B2
(45) **Date of Patent: *Dec. 4, 2012**

(54) METHODS AND APPARATUS TO SCORE BOOK COVERS

(75) Inventors: James M. Lanman, Charleston, IL (US); Patrick S. Lawson, Ashmore, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/371,056

(22) Filed: Feb. 10, 2012

(65) Prior Publication Data

US 2012/0141230 A1 Jun. 7, 2012

Related U.S. Application Data

(63) Continuation of application No. 12/173,601, filed on Jul. 15, 2008, now Pat. No. 8,128,331.

(51) Int. Cl.
*B42C 7/00* (2006.01)

(52) U.S. Cl. ..... 412/17

(58) Field of Classification Search ..... 412/17, 412/3, 18, 4; 281/29; 225/2, 94–96.5; 83/879–887, 83/471.2, 482, 492–503, 505, 506, 904; 72/185, 72/186, 203, 179, 182
See application file for complete search history.

(56) References Cited

U.S. PATENT DOCUMENTS

| | | | | |
|---|---|---|---|---|
| 1,711,363 | A | 4/1929 | Pleger | |
| 2,048,684 | A | 7/1936 | Carr | |
| 2,313,609 | A | 3/1943 | Wright | |
| 3,314,089 | A | 4/1967 | Margolis et al. | |
| 3,917,255 | A | 11/1975 | Watrous | |
| 4,524,962 | A | 6/1985 | Davenport et al. | |
| 4,627,214 | A | 12/1986 | Anderson et al. | |
| 5,045,045 | A | 9/1991 | Davenport et al. | |
| 5,232,324 | A | 8/1993 | Graushar | |
| 5,364,215 | A | 11/1994 | Snellman et al. | |
| 5,779,423 | A | 7/1998 | Bermingham | |
| 5,797,320 | A | 8/1998 | Buschulte et al. | |
| 5,873,807 | A | 2/1999 | Lauderbaugh et al. | |
| 5,921,752 | A | 7/1999 | Sinke et al. | |
| 6,142,721 | A | 11/2000 | Marsh | |
| 6,364,590 | B1 | 4/2002 | Gayoso | |
| 6,460,843 | B1 | 10/2002 | Dim et al. | |
| 6,705,604 | B2 | 3/2004 | Lorenzi | |
| 6,748,781 | B2 * | 6/2004 | Felgen | 72/185 |
| 8,128,331 | B2 | 3/2012 | Lanman et al. | |
| 2007/0209752 | A1 | 9/2007 | Rygol et al. | |
| 2010/0014944 | A1 | 1/2010 | Lanman et al. | |

OTHER PUBLICATIONS

United States Patent and Trademark Office, "Notice of Allowance," issued in connection with U.S. Appl. No. 12/173,601, mailed Oct. 28, 2011, 17 pages. United States Patent and Trademark Office, "Non-Final Office Action," issued in connection with U.S. Appl. No. 12/173,601, mailed Apr. 28, 2011, 24 pages.

* cited by examiner

*Primary Examiner* — Dana Ross
*Assistant Examiner* — Matthew G Katcoff
(74) *Attorney, Agent, or Firm* — Hanley, Flight & Zimmerman, LLC

(57) ABSTRACT

Apparatus and methods to score book covers are described. An example scoring apparatus includes a first scoring roll and a corresponding second scoring roll. The first scoring roll opposes the second scoring roll to process a cover at a first location of the cover. A first slider to couple the first scoring roll to the scoring apparatus such that the first slider enables independent adjustment of the first scoring roll relative to the second scoring roll in a first lateral direction relative to the second scoring roll.

20 Claims, 6 Drawing Sheets

METHODS AND APPARATUS TO SCORE BOOK COVERS

CROSS-REFERENCE TO RELATED APPLICATIONS

This patent arises from a continuation of U.S. patent application Ser. No. 12/173,601, filed Jul. 15, 2008, entitled "METHODS AND APPARATUS TO SCORE BOOK COVERS," which is herein incorporated by reference in its entirety.

FIELD OF THE DISCLOSURE

The present disclosure relates generally to binding lines and, more particularly, to methods and apparatus to score book covers.

BACKGROUND

Binding systems such as, for example, perfect binding lines, are often used to mass produce soft-cover books such as, for example, paperback books, catalogues, text books, periodicals, magazines, etc. Soft-cover books typically include a book block comprising multiple sheets or signatures (i.e., pages) that correspond to respective pages of a book that are coupled to a book cover. The sheets of the book block are bound together at an edge to form a spine.

Scoring machines are used to prepare a cover of a book for attachment to the book block. A scoring machine includes a set of dies that produce a first set of marks or score lines that are spaced a distance apart on the cover. The first set of score lines defines or forms a spine on the book cover. The thickness of the spine of the book cover (i.e., the distance between the first set of score lines) is sized substantially equal to the thickness of the spine of the book block. The book block is attached (e.g., via adhesive) to the spine of the cover to form a book.

A die set of a scoring apparatus typically has an upper roll that opposes a complementary lower roll to produce a score line on the cover. The upper and lower scoring rolls are typically driven by respective drive members such as, for example, motors, drive transmissions, gears, etc. Driving both the upper and lower rolls provides greater control to prevent skewing of the cover as it is processed through the scoring apparatus. However, such a configuration requires additional moving parts and increased maintenance, which results in increased cost. Additionally, typical scoring apparatus require a large overall foot print (e.g., floor space area).

DETAILED DESCRIPTION

In general, the example scoring apparatus described herein can be used to prepare a cover of a book for attachment to a book block. Typically, the example scoring apparatus can process precut book cover blanks made of, for example, a soft, flexible paper material. The book cover blanks may be preprinted and/or precut to size. The cover stock may be any suitable cover stock material but is usually made of a soft, paper cover stock material that is flexible, but heavier and thicker than the pages of the book block. The book block comprises multiple sheets or signatures (i.e., pages) that are bound together at an edge (e.g., via adhesive) that forms a spine.

The example scoring apparatus described herein includes a first set of scoring rolls that produce or form a first set of marks or score lines on a book cover, where the marks or score lines can be spaced apart a distance that is equal to a thickness of a book block. The example scoring apparatus may also include a second set of scoring rolls that produce or form a second set of score lines adjacent and outwardly spaced from the first set of score lines to provide a hinge to the book cover to enable the cover to open easily when the book cover is bound to the book block. Each of the first and second sets of scoring rolls includes upper scoring rolls that oppose respective lower scoring rolls to form the score lines. The lower scoring rolls of the first and second set of scoring rolls are mechanically driven, and the upper scoring rolls of the first and second set of scoring rolls rotate freely. In another example, the scoring apparatus may include a plurality of scoring rolls that form a plurality of score lines on a book cover.

The example scoring apparatus described herein can be retrofit to existing binding line systems such as, for example, to cover feeders, raceways, etc., and may be used in-line with a book binding production line (e.g., a perfect binding production line). Alternatively, the example scoring apparatus may be used as a standalone unit. In contrast to many known scoring apparatus, the example scoring apparatus described herein has a reduced number of moving parts and, thus, the example scoring apparatus requires less maintenance, has reduced complexity, and is less expensive. Furthermore, the scoring apparatus is more compact, requires a smaller overall foot print (e.g., floor space area) than these known scoring apparatus. Decreasing the foot print or the required floor space area can increase production by enabling an increase in the number of production lines (e.g., bindery lines) that can be installed in a particular area. For example, the example scoring apparatus described herein only requires a small foot print (e.g., fourteen inches) when retrofitting the example scoring apparatus to an existing cover feeder and/or raceway.

Figure 1:
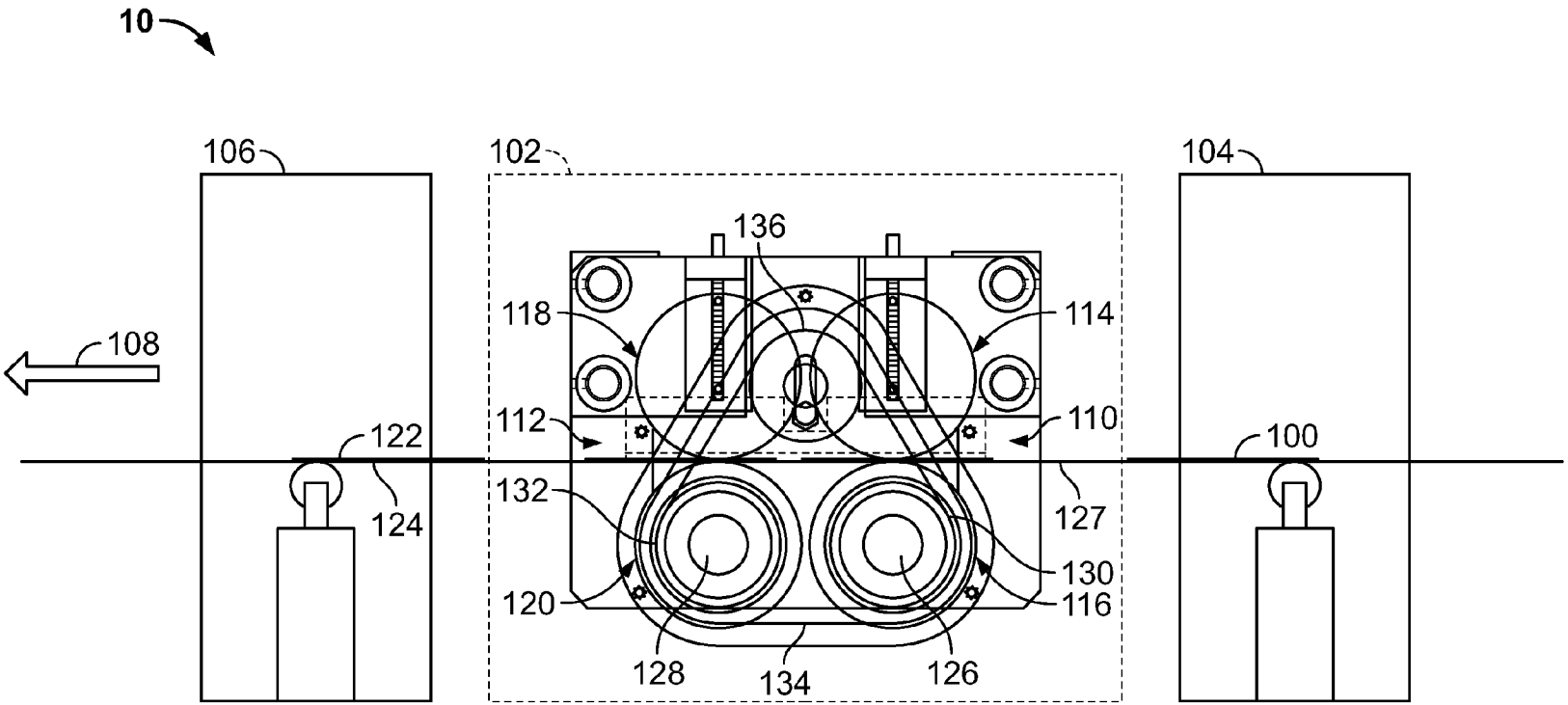
FIG. 1 illustrates an example production system configured to process a book cover using an example scoring apparatus described herein.

FIG. 1 illustrates an example production system 10 configured to process a book cover 100 using an example scoring apparatus 102 described herein. In some examples, the example production system 10 may be part of a mass production binding system, which may include a plurality of subsystems that modify or alter the book cover 100 using processes that, for example, print, trim, cut, stack, transport, etc., the book cover 100. For example, the scoring apparatus 102 may be implemented with a perfect binding system, which may be used to produce soft-cover books such as, for example, paperback books, catalogues, text books, periodicals, magazines, etc. In alternative example implementations, the scoring apparatus 102 may be implemented as a standalone system and/or a hand-fed system, etc. In a standalone configuration, the example scoring apparatus 102 may include a housing or a frame (e.g., a stand).

The example scoring apparatus 102 may be placed between a first operating unit 104 and a second, subsequent operating unit 106. The book cover 100 travels from the first operating unit 104, through the scoring apparatus 102 to the second operating unit 106 in a direction generally indicated by arrow 108. The first operating unit 104 may be a cover feeder, a hopper, a raceway, a printer, etc., and the second operating unit 106 may be an adhesive application station, a trimmer, a material delivery system such as, for example, a stacker, a conveyor, etc. Additionally, the first and second operating units 104 and 106 may be any desired type of process associated with a book binding manufacturing system or the like.

In the illustrated example, the scoring apparatus 102 includes a first set of scoring rolls 110 and a second set of scoring rolls 112. The first set of scoring rolls 110 includes a first plurality of upper scoring rolls 114 that oppose a complementary first plurality of lower scoring rolls 116 to process the cover 100 and form a corresponding first plurality of score lines on the cover 100. Likewise, the second set of scoring rolls 112 includes a second plurality of upper scoring rolls 118 that oppose a complementary second plurality of lower scoring rolls 120 that process the cover 100 to form a corresponding second plurality of score lines thereon that are different from the first plurality of score lines produced by the first set of scoring rolls 110. The first set of scoring rolls 110 and the second set of scoring rolls 112 may be configured to form score lines on a first surface 122 of the cover 100, a second surface 124 of the cover 100, and/or a combination of both the first and second surfaces 122 and 124. The upper scoring rolls 118 are positioned above a conveyor 127 and the lower scoring rolls are positioned below the conveyor 127 so that the book cover 100 travels between the upper and the lower scoring rolls 114, 116, 118, and 120.

The first plurality of upper scoring rolls 114 and the second plurality of upper scoring rolls 118 are not driven and, thus, rotate freely about their respective first and second axes. The first plurality of lower scoring rolls 116 and the second plurality of lower scoring rolls 118 are mechanically driven (e.g., via a motor) and rotate about their respective third and fourth axes. The lower scoring rolls 116 are mounted to a shaft 126, which is driven or rotated by a drive member described in greater detail below. Similarly, the lower scoring rolls 120 are mounted to a shaft 128. The shaft 126 includes a pulley 130 and the shaft 128 includes a pulley 132. The pulley 130 is operatively coupled to the pulley 132 via a belt 134 so that the drive member also drives the shaft 128 (i.e., via the shaft 126). An adjustable idle pulley 136 adjusts the tension in the belt 134 to prevent slippage. In alternative example implementations, other drive configurations may be used. For example, various drive members may be coupled to each other using any combination of chains, frictional engagement devices, etc. Of course, one or more of the pulleys 130, 132, and/or 136 may be replaced with gears, sprockets, or any other suitable drive members.

Figure 2A:
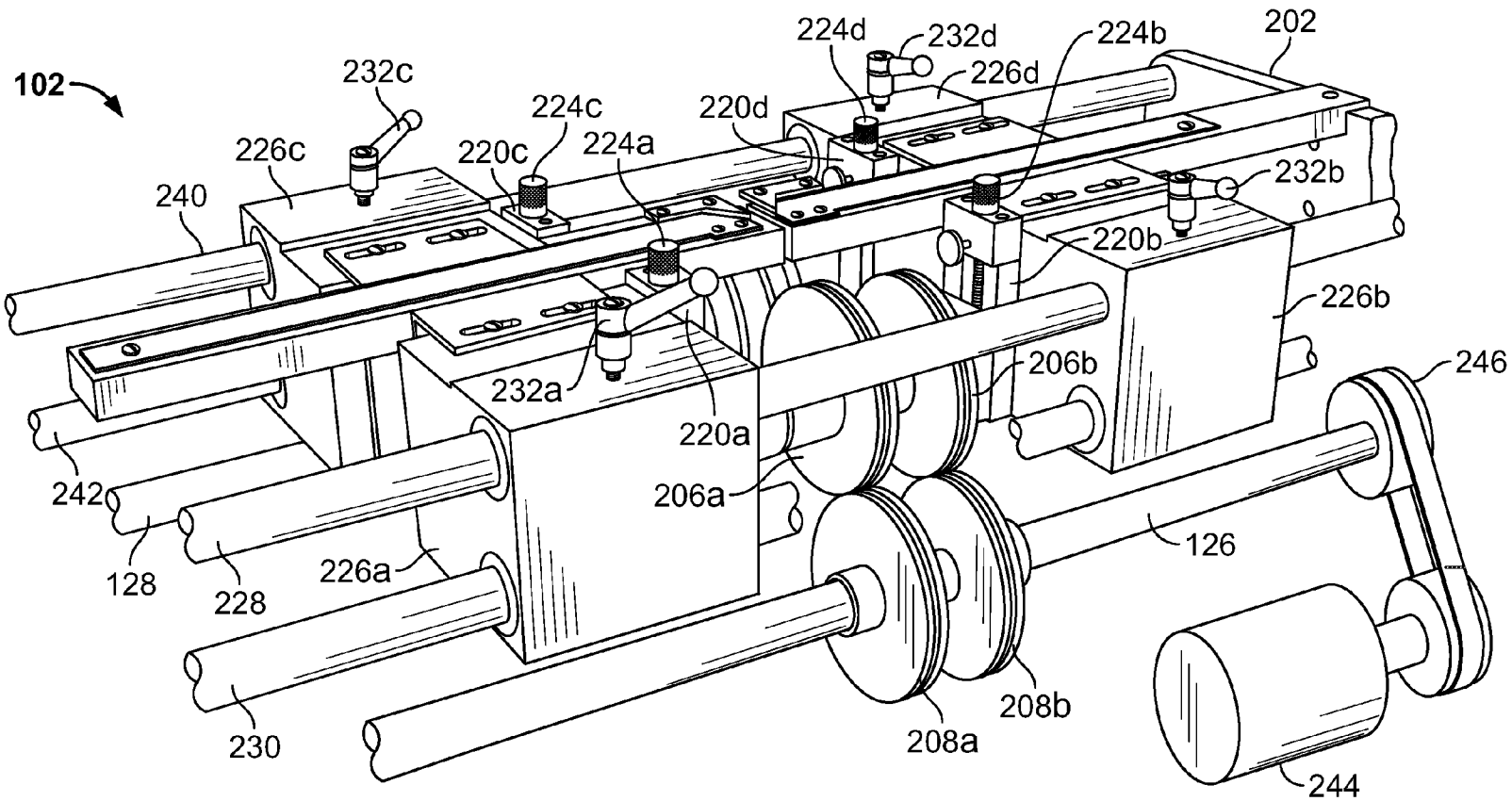
FIG. 2A is another view of the example scoring apparatus of FIG. 1.
Figure 2B:
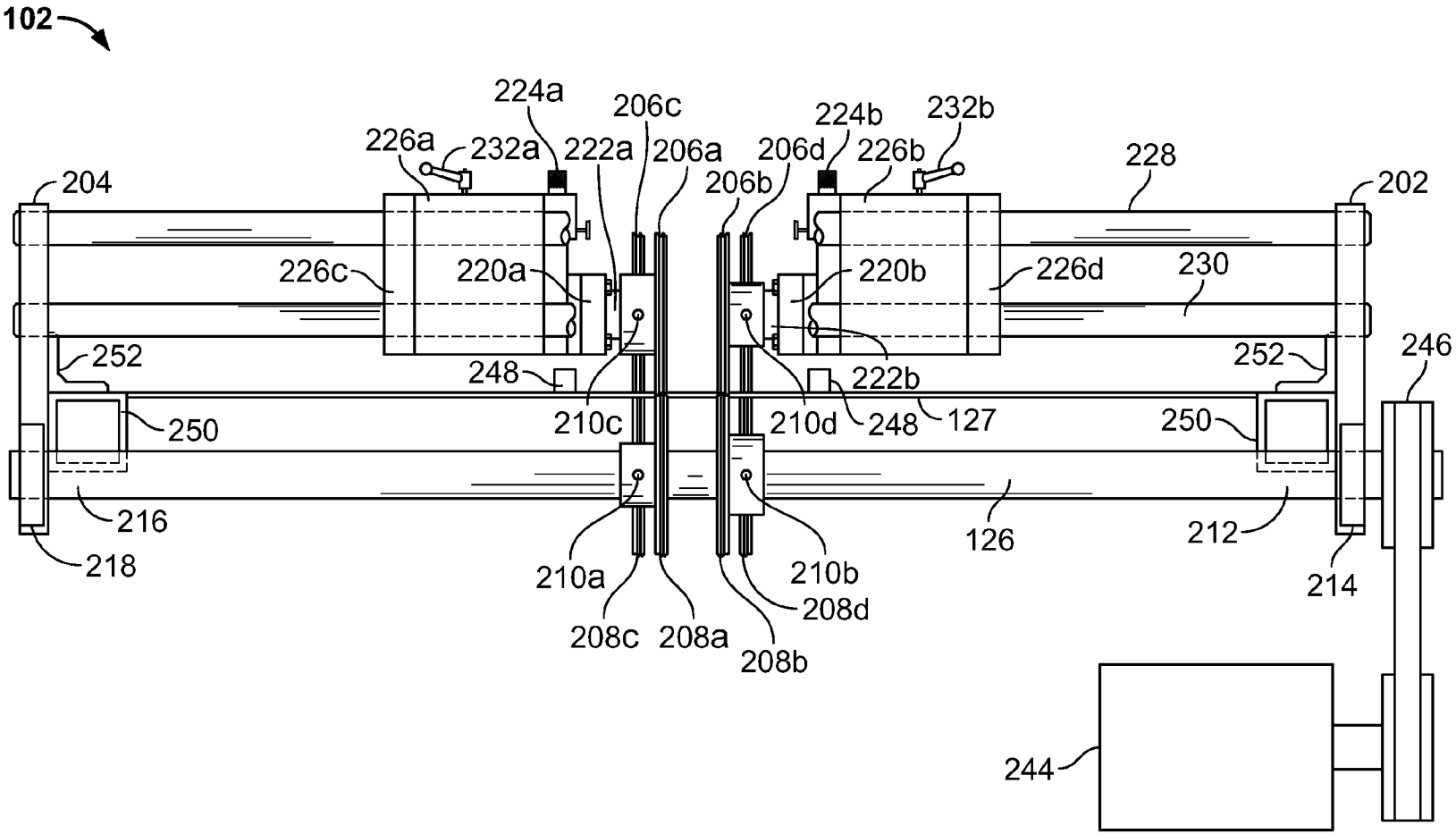
FIG. 2B illustrates a side view of the example scoring apparatus of FIGS. 1, and 2A.
Figure 2C:
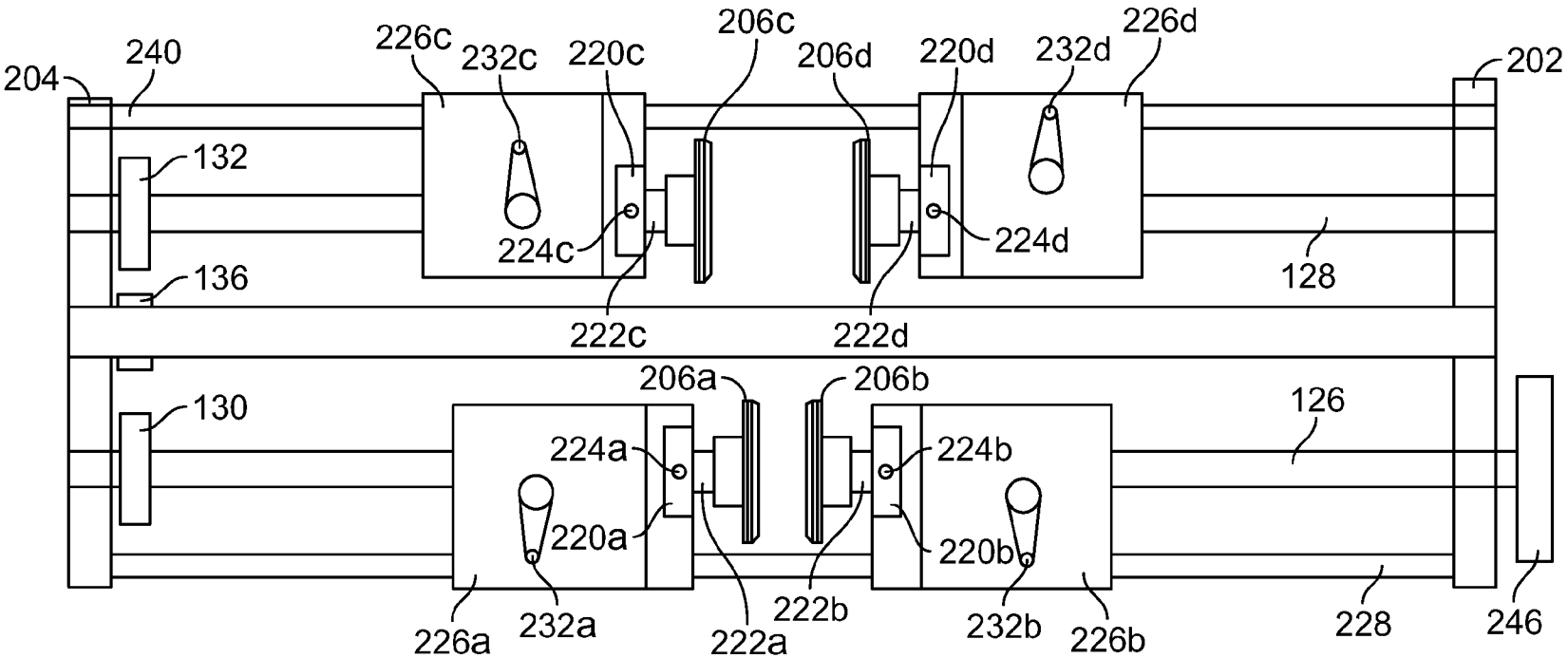
FIG. 2C illustrates a plan view of the example scoring apparatus of FIGS. 1, 2A, and 2B.

FIG. 2A is another view of a portion of the example scoring apparatus 102 shown in FIG. 1. FIG. 2B is a front view of the example scoring apparatus 102 shown in FIGS. 1 and 2A. FIG. 2C is a plan view of the example scoring apparatus 102 shown in FIGS. 1, 2A, and 2B. Referring to FIGS. 1, 2A, 2B, and 2C, the first set of scoring rolls 110 and the second set of scoring rolls 112 are disposed between a first plate or housing 202 and a second plate or housing 204. The first set of scoring rolls 110 includes upper scoring rolls 206*a* and 206*b* and corresponding lower scoring rolls 208*a* and 208*b*. The upper scoring rolls 206*a* and 206*b* oppose the respective lower scoring rolls 208*a* and 208*b* to score or penetrate the cover 100 to form score lines that define, for example, a spine portion of the cover 100. The second set of scoring rolls 112 includes upper scoring rolls 206*c* and 206*d* and corresponding lower scoring rolls 208*c* and 208*d*. Similarly, the upper scoring rolls 206*c* and 206*d* oppose the respective lower scoring rolls 208*c* and 208*d* to score or penetrate the cover 100 to form score lines adjacent and spaced outwardly from the first set of score lines that, for example, define hinges of the book cover 100. In other examples, the second set of scoring rolls 112 may be positioned to form the score lines that define the spine and the first set of scoring rolls 110 may be positioned to form the score lines that define the hinges. In yet other examples, only the first set of scoring rolls 110 or the second set of scoring rolls 112 is configured to form the score lines that define the spine.

The lower scoring rolls 208*a* and 208*b* are coupled to the shaft 126 via screws 210*a* and 210*b*, respectively. A first end 212 of the shaft 126 is rotatably coupled to the first plate 202 via a bearing 214 and a second end 216 of the shaft 126 is rotatably coupled to the second plate 204 via a bearing 218. The upper scoring rolls 206*a* and 206*b* are rotatably coupled to respective brackets 220*a* and 220*b* via stub shafts 222*a* and 222*b*. The brackets 220*a* and 220*b* are vertically adjustable via respective adjusting screws 224*a* and 224*b*, which may be rotated to vertically adjust the upper scoring rolls 206*a* and 206*b* relative to the lower scoring rolls 208*a* and 208*b*. In other examples, the brackets 220*a* and 220*b* are also horizontally adjustable via adjusting screws (not shown) to enable the lateral positions of the upper scoring rolls 206*a* and 206*b* to be adjusted relative to the lower scoring rolls 208*a* and 208*b*.

A first linear slide 226*a* and a second linear slide 226*b* couple the brackets 220*a* and 220*b* and, thus, the upper scoring rolls 206*a* and 206*b* to the first plate 202 and the second plate 204 via shafts 228 and 230. The linear slides 226*a* and 226*b* slidably move along the shafts 228 and 230 between the first plate 202 and the second plate 204 to adjust the lateral position of the upper scoring rolls 206*a* and 206*b* relative to the lower scoring rolls 208*a* and 208*b*. The linear slides 226*a* and 226*b* include hold down levers 232*a* and 232*b*, respectively, that operate between a first or release position to enable the linear slides 226*a* and 226*b* to slide along shafts 228 and 230 to adjust the position of the upper rolls 206*a* and 206*b* and a second or secure position that locks or prevents the linear slides 226*a* and 226*b* from moving along the shafts 228 and 230.

The second set of scoring rolls 112 has components that are substantially similar or identical to the components of the first set of scoring rolls 110 described above and the functions of those components will not be described in detail again below. Instead, the interested reader is referred to the above corresponding descriptions. For example, the lower scoring rolls 208*c* and 208*d* are coupled to the first plate 202 and the second plate 204 via the shaft 128 in substantially the same manner as the lower rolls 208*a* and 208*b* are coupled to the shaft 126. The upper scoring rolls 206*c* and 206*d* are coupled to the first plate 202 and the second plate 204 in substantially the same or identical manner as the upper rolls 206*a* and 206*b* are coupled to the first plate 202 and the second plate 204 and are associated with components that are the substantially similar or identical to the components of the upper rolls 206*a* and 206*b*. The upper scoring rolls 206*c* and 206*d* are associated with components 220*c*, 220*d*, 222*c*, 222*d*, 224*c*, 224*d*, 226*c*, 226*d*, 232*c*, 232*d*, 240, and 242 that are substantially similar or identical to the components 220*a*, 220*b*, 222*a*, 222*b*, 224*a*, 224*b*, 226*a*, 226*b*, 232*a*, 232*b*, 228, and 230 associated with the upper scoring rolls 206*a* and 206*b*.

To drive the scoring apparatus 102, a drive member 244 shown in FIGS. 2A and 2B is operatively coupled to a drive gear 246. The drive member 244 may be any drive system or member of an existing binding line system such as, for example, a drive of a cover feeder, a drive of a conveyor, or any other suitable drive system that may be operatively coupled to the drive gear 246 via respective couplings such as, for example, drive shafts, gear transmission systems, etc. Alternatively, the drive member 244 may include any suitable motor such as, for example, a stepper motor, a servo motor, a hydraulic motor, etc. The drive member 244 drives the drive gear 246, which is coupled to the shaft 126 to drive the lower scoring rolls 206*a* and 206*b*. Alternatively, the drive gear 246 may be replaced with a pulley, a sprocket, or any other suitable drive member(s). In some example implementations, the drive member 244 may be coupled to the drive gear 246 with or without an intervening gear box. As noted above, the gear 130 (FIG. 1) of the shaft 126 is operatively coupled to the gear 132 (FIG. 1) of the shaft 128 so that the drive member 244 also drives the shaft 128 via the shaft 126. Each of the upper scoring rolls 206*a-d* is not driven and, thus, rotates freely as the cover 100 travels through the scoring apparatus 102.

The upper and lower scoring rolls 206*a* and 208*a* are positioned or set to a corresponding gauge line or center line CL (FIG. 2C) of a binder system. The center line CL is used as a reference point to measure or set the position of the first and the second sets of scoring rolls 110 and 112. In the illustrated example of FIG. 2C, for example, the upper and lower scoring rolls 206*a* and 208*a* are aligned with the center line CL and the upper and lower scoring rolls 206*b* and 208*b* are positioned at a distance away from the upper and lower scoring rolls 206*a* and 208*a* that is substantially equal to the thickness of a spine of a book block (e.g., a spine 408 of a book block 401 of FIG. 4B). The upper and lower scoring rolls 206*c* and 208*c* and the upper and lower scoring rolls 206*c* and 208*d* are adjusted to a position at a distance outwardly spaced from the respective upper and lower scoring rolls 206*a* and 208*a* and 206*b* and 208*b*. The upper scoring rolls 206*c* and 206*d* oppose the lower scoring rolls 208*c* and 208*d*, respectively, to produce score lines that define hinges that enable a book to open easier (e.g., hinge score lines 420 and 422 of FIG. 4A). As noted above, the upper scoring rolls 206*a-d* may include a lateral or horizontal adjustment to facilitate precise adjustment of the upper scoring rolls 206*a-d* relative to the lower scoring rolls 208*a-d*. Depending on the thickness or gauge of a book cover, the depth of the score line(s) may be adjusted via the vertical adjustment screws 224*a-d*.

Once the positions of the upper and lower scoring rolls 206*a-d* and 208*a-d* are set, the book cover 100 is processed (e.g., fed) through the scoring apparatus 102. The conveyor 127 of, for example, a cover feeder, may deliver the book cover 100 to the scoring apparatus 102. The conveyor 127 may include an adjustable slide guide (not shown) to maintain alignment of the book cover with the center line CL and the upper and lower scoring rolls 206*a-d* and 208*a-d*. The conveyor 127 includes chain lugs 248 to advance the book cover 100 to the scoring apparatus 102.

The shaft 126 on which the lower scoring rolls 208*a* and 208*b* are mounted, rotates to feed the book cover 100 through the first set of scoring rolls 110. As noted above, the upper scoring rolls 206*a* and 206*b* are not driven and rotate freely. Additionally or alternatively, the scoring apparatus 102 may include nip rolls (not shown) to help feed or advance the book cover 100 to the first set of scoring rolls 110. As the cover passes between the first set of scoring rolls 110, the upper scoring rolls 206*a* and 206*b* and the lower scoring rolls 208*a* and 208*b* penetrate or impresses upon the cover 100 to create score lines (e.g., score lines 402 and 404 of FIG. 4A) that define a spine (e.g., a spine 406 of FIG. 4A) of a book cover (e.g., a book cover 400 of FIG. 4A). The scoring rolls 206*a-b* and 208*a-b* apply sufficient pressure to the cover 100 to create effective score lines without tearing the book cover. For greater penetration, the pressure exerted by the scoring rolls 206*a-b* can be increased or decreased via the vertical adjustment screws 224*a-b*.

The second shaft 128 on which the lower scoring rolls 208*c-d* are mounted is driven by the drive gear 246 via the shaft 126 and the gears 130 and 132. The upper scoring rolls 206*c* and 206*d* are not driven and freely rotate. As the cover 100 passes between the second set of scoring rolls 112, the upper scoring rolls 206*c* and 206*d* oppose the lower scoring rolls 208*c* and 208*d*, respectively, to penetrate or impress upon the cover 100 to create score lines (e.g., score lines 420 and 422 of FIG. 4A) that define hinges or fold lines of a cover (e.g., the example cover 400 of FIG. 4A). The upper scoring rolls 206*c* and 206*d* apply sufficient pressure to the cover 100 and the lower scoring rolls 208*c* and 208*d* to create effective score lines without tearing the book cover 100. For greater penetration, the pressure of the upper score rolls 206*c-d* can be increased or decreased via the vertical adjustment screws 236*c-d*.

As stated above, the scoring apparatus 102 can be retrofit to existing binding line systems and/or to components or portions of these binding line systems. For example, the scoring apparatus 102 may be retrofit to a cover feeder and/or raceway extension. To retrofit an existing cover feeder, the first plate 202 and the second plate 204 are mounted to a supporting member 250 of, for example, a cover feeder via brackets 252 (e.g., "L" brackets). When retrofitting an existing cover feeder, an existing drive system or member of the cover feeder, or any other suitable drive system of the binding line system may be implemented or operatively coupled to drive the gear 246 via respective couplings such as, for example, drive shafts, gear transmission systems, etc. In this manner, the lower scoring rolls 208*a* and 208*b* supported by the shaft 126 and the lower scoring rolls 208*c* and 208*d* supported by the shaft 128 rotate at the line speed of the existing system (e.g., the cover feeder) and the linear speed of the book covers (e.g., the book cover 100) advancing to the scoring apparatus 102.

In some examples, a raceway extension, conveyor extension, etc., may be used to retrofit the scoring apparatus 102 to an existing cover feeder, raceway, etc. The raceway extension comprises, for example, a steel frame that is compatible with an existing cover raceway and cover feeder. The raceway extension may be any length (e.g., four feet in length) and may include an adjustable slide guide mechanism that can integrate with existing cover raceway slide guides to maintain alignment of the book cover with the center line CL of the binder system and the upper and lower scoring rolls 206*a-d* and 208*a-d*. The raceway extension may include chain lugs (e.g., the chain lugs 248) to move the book covers to the scoring apparatus 102. Retrofitting the scoring apparatus 102 to an existing binding line may require a control system (e.g., program, software, etc.) for a missing book and corresponding book cover to be modified.

Alternatively, the scoring apparatus 102 may be a standalone system and may be mounted to a frame and/or a stand. In a standalone configuration, the drive member 244 may include any suitable motor such as, for example, a stepper motor, a servo motor, a hydraulic motor, etc. The standalone frame or stand includes a conveyor (e.g., the conveyor 127) and chain lugs (e.g., the chain lugs 248) to advance the book covers through the scoring apparatus 102.

Figure 3A:
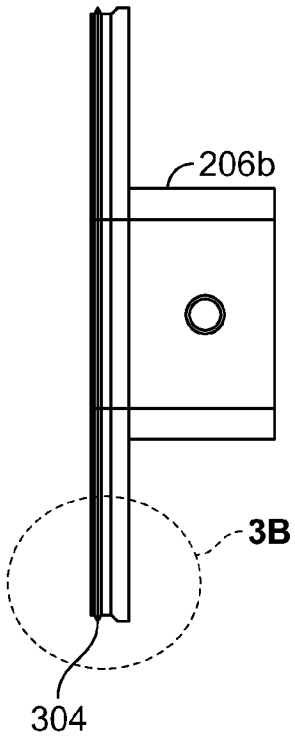
FIGS. 3A-3D illustrate example upper and lower scoring rolls that may be used with the example scoring apparatus of FIGS. 1 and 2A-2C.
Figure 3B:
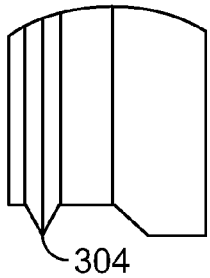
Figure 3C:
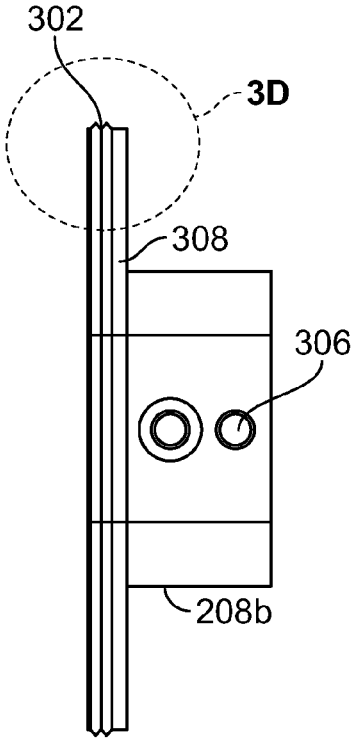
Figure 3D:
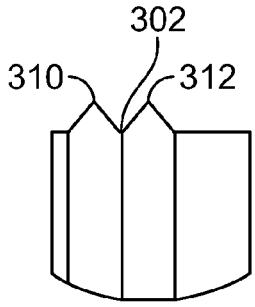

FIG. 3A illustrates the upper scoring roll 206*b* and FIG. 3C illustrates the lower scoring roll 208*b*. FIG. 3B illustrates an enlarged portion of the upper scoring roll 206*b* and FIG. 3D illustrates an enlarged portion of the lower scoring roll 208*b*. The lower scoring roll 208*b* has a recessed slot 302 around its peripheral edge. The upper scoring roll 206*b* includes a protruding edge 304 around its peripheral edge where the protruding edge 304 opposes and complements the recessed slot 302 of the lower scoring roll 208*b*. The edge 304 flexes or conforms the book cover 100 within the opposing slot 302 to form a score line on the book cover 100 when the cover 100 is processed through the scoring apparatus 102 between the upper and lower scoring rolls 206*b* and 208*b*. As noted above, the depth of a score line can be adjusted via the vertical adjustment screw 224*b* of FIGS. 2A-2C to adjust a gap between the protruding edge 304 relative to the slot 302.

Additionally, the lower scoring roll 208*b* includes an adjustment screw 306 to adjust the thickness of the slot 302 to accommodate book covers having different thicknesses or weights. The lower scoring roll 208*b* includes a sleeve 308 that may be adjusted so that a first contact point 310 may be moved further apart from, or closer to, a second contact point 312 to increase or decrease the width or size of the slot 302. A lower scoring roll having a slot with an increased size or width can provide a proper score line for thicker book covers by allowing a thicker book cover to flex or conform to the slot when the edge 304 of the upper scoring roll 206*b* opposes a thicker cover. Thus, for thicker book covers, the upper scoring roll 206*b* may be vertically adjusted via the vertical adjusting screw 236*b* so that the depth of edge 304 of the upper scoring roll 206*b* further penetrates the slot 302 of the lower scoring roll 208*b* and the slot 302 of the lower scoring wheel 208*b* may be laterally adjusted to increase the size of the slot 302 to allow thicker book covers to flex when the upper scoring roll 206*b* penetrates the thicker book cover and the slot 304.

Figure 4A:
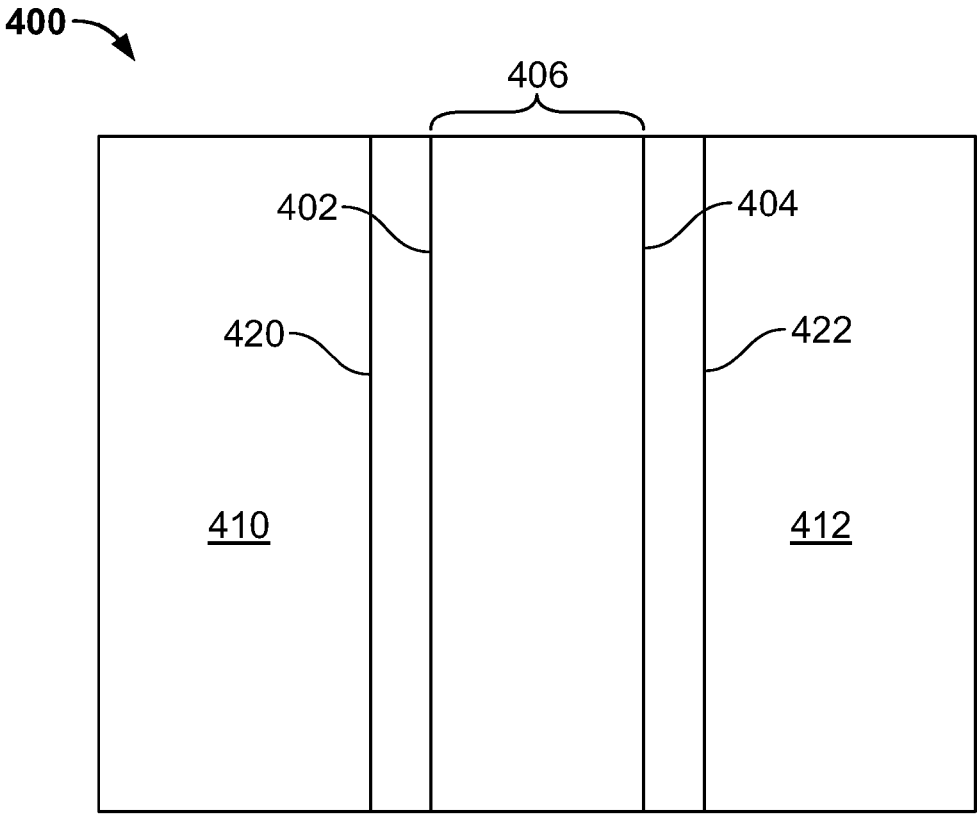
FIGS. 4A and 4B illustrate an example book cover processed by the example scoring apparatus of FIGS. 1 and 2A-2C.
Figure 4B:
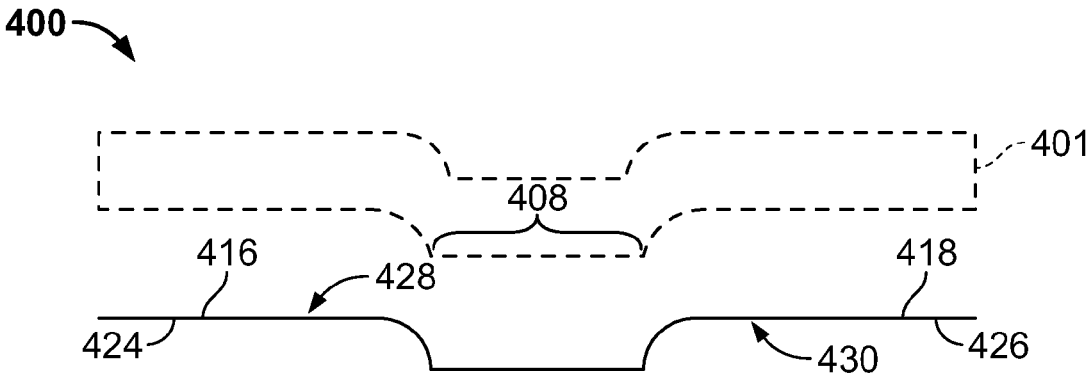

FIG. 4A illustrates the example book cover 400 processed by the scoring apparatus 102. FIG. 4B illustrates an end view of the example book cover 400 of FIG. 4A with the example book block 401 to be attached to the book cover 400. Referring to FIGS. 4A and 4B, the book cover 400 includes the score line 402 formed by the upper scoring roll 206*a* and the lower scoring roll 208*a*, and the score line 404 formed by the upper scoring roll 206*b* and the lower scoring roll 208*b*. The score lines 402 and 404 define the spine 406 of the book cover 400. The thickness of the spine 406 (e.g., the distance between the score line 402 and the score line 404) is sized substantially equal to the thickness of the spine 408 of the book block 401. The scoring line 402 is formed by positioning the upper and lower scoring rolls 206*a* and 208*a* on the center line CL, and the scoring line 404 is formed by positioning the scoring rolls 206*b* and 208*b* a distance from the center line CL corresponding to the spine 412 of a book block 401.

The spine 408 of the book block 401 is attached to the spine 406 of the book cover 400 to form a book. The cover 400 includes a front cover portion 410 and a back cover portion 412 that are hinged to the spine portion along the score lines 402 and 404. The score lines 402 and 404 enable a first inside surface 416 of the front cover 410 to fold toward a second inside surface 418 of the back cover 412.

The example book cover 400 also includes the score line 420 adjacent to the score line 402 and the score line 422 adjacent to the score line 404. The score line 420 is formed by the upper and lower scoring rolls 206*c* and 208*c* and the score line 422 is formed by the upper and lower scoring rolls 206*d* and 208*d*. The score line 420 is at a distance outwardly spaced from the score line 402, and the score line 422 is at a distance outwardly spaced from the score line 404. The score line 420 provides a hinge to a first outer surface 424 of the front cover 410 and score line 422 provides a hinge to a second outer surface 426 of the back cover 412 that enables the first and second outer surfaces 424 and 426 to fold toward each other (i.e., enables the book cover 400 to break open while the book block remains flat after it is attached to the book cover 400).

In other examples, the book cover 400 may be prepared without the score lines 420 and 422. The upper scoring rolls 206*c-d* may be vertically adjusted so that they do not oppose their respective lower scoring rolls 208*c-d*. Additionally, the second set of scoring rolls 112 may produce the scoring lines 402 and 404 and the first set of scoring rolls 110 may produce the score lines 420 and 422. In yet another example, the score lines 402, 404, 420, and 422 may all be formed on a first side 428 of the cover, on a second side 430 of the cover, and/or a combination of both the first and second sides 428 and 430. In yet another alternative example, a book cover may be scored with only one score line at any location along a cover and/or on either side of a cover.

Although certain apparatus and articles of manufacture have been described herein, the scope of coverage of this patent is not limited thereto. To the contrary, this patent covers all apparatus and articles of manufacture fairly falling within the scope of the appended claims either literally or under the doctrine of equivalents.

What is claimed is:

1. A scoring apparatus for use in bindery applications, comprising:

a first scoring roll and a corresponding second scoring roll, the first scoring roll to oppose the second scoring roll to process a cover at a first location of the cover; and a first slider to couple the first scoring roll to the scoring apparatus, the first slider to enable independent adjustment of the first scoring roll relative to the second scoring roll in a first lateral direction relative to the second scoring roll and to enable independent adjustment of the first scoring roll relative to the second scoring roll in a second lateral direction relative to the second scoring roll, the first lateral direction being non-parallel relative to the second lateral direction.

2. A scoring apparatus as defined in claim 1, wherein the first scoring roll is manually adjustable in the first lateral direction via the first slider.

3. A scoring apparatus as defined in claim 1, wherein the first slider includes a first adjustor to enable the independent adjustment of the first scoring roll in the first lateral direction relative to the second scoring roll.

4. A scoring apparatus as defined in claim 3, wherein the first slider includes a second adjustor to enable adjustment of the first scoring roll in the second lateral direction relative to the second scoring roll.

5. A scoring apparatus as defined in claim 1, wherein the first slider is slidably coupled to a first shaft of the scoring apparatus.

6. A scoring apparatus as defined in claim 1, further comprising a third scoring roll and a corresponding fourth scoring roll, the third scoring roll to oppose the fourth scoring roll to process the cover at a second location of the cover.

7. A scoring apparatus as defined in claim 6, wherein the first and the third scoring rolls rotate freely about a first axis of rotation and the second and the fourth scoring rolls are mechanically driven and rotate about a second axis of rotation.

8. A scoring apparatus as defined in claim 6, further comprising a second slider to couple the third scoring roll to the scoring apparatus, the second slider having a first adjustor to enable adjustment of the third scoring roll in a second lateral direction relative to the first and second scoring rolls and a second adjustor to enable adjustment of the third scoring roll in a third lateral direction relative to the first and second scoring rolls, wherein the second lateral direction is different than the third lateral direction.

9. A scoring apparatus comprising:

a housing having a first shaft parallel to a second shaft;

a first slider to couple a first scoring roll from a first plurality of scoring rolls to the first shaft, the first slider having:

a first adjustor to enable the first scoring roll to be independently adjustable in a first lateral direction relative to a second scoring roll from a second plurality of scoring rolls coupled to the second shaft and at least a third scoring roll from the first plurality of scoring rolls coupled to a third shaft parallel to the first shaft; and a second adjustor to enable the first scoring roll to be independently adjustable in a second lateral direction relative to the second scoring roll and the at least third scoring roll, the first lateral direction being different than the second lateral direction.

10. A scoring apparatus as defined in claim 9, wherein the second adjustor of the first slider is movable between a first position to prevent movement of the first scoring roll in the second lateral direction and a second position to enable movement of the first scoring roll in the second lateral direction.

11. A scoring apparatus as defined in claim 9, wherein the first adjustor comprises an adjustment screw and the second adjustor comprises a lever.

12. A scoring apparatus as defined in claim 9, wherein the second scoring roll of the second plurality of scoring rolls is mechanically driven and the first scoring roll of the first plurality of scoring rolls rotates freely.

13. A scoring apparatus as defined in claim 9, further comprising a second slider to couple the third scoring roll from the first plurality of scoring rolls to the third shaft.

14. A scoring apparatus as defined in claim 13, wherein the second slider comprises a third adjustor to enable the third scoring roll to be independently adjustable in a third lateral direction relative to the first scoring roll and the second scoring roll.

15. A scoring apparatus as defined in claim 14, wherein the third lateral direction is parallel to the first lateral direction.

16. A scoring apparatus as defined in claim 14, wherein the second slider comprises a fourth adjustor to enable the third scoring roll to be independently adjustable in a fourth lateral direction relative to the first and second scoring rolls, the fourth lateral direction being different than the third lateral direction.

17. A scoring apparatus comprising:

means for attaching a first scoring roll to a first shaft, the means for attaching comprising:

first means for adjusting the first scoring roll in a first lateral direction relative to a second scoring roll cooperating with the first scoring roll and a third scoring roll adjacent the first and second scoring rolls; and second means for adjusting the first scoring roll in a second lateral direction relative to the second scoring roll and the third scoring roll, the first lateral direction being different than the second lateral position.

18. A scoring apparatus as recited in claim 17, wherein the first means for adjusting enables adjustment of the first scoring in the first lateral direction independent from the second and third scoring rolls and the second means for adjusting enables adjustment of the first scoring roll in the second lateral direction independent from the second and third scoring rolls.

19. A scoring apparatus as recited in claim 17, wherein the first means for adjusting comprises first means for locking the position of the first means for adjusting to prevent movement of the first scoring roll in the first lateral direction and means for unlocking the position of the first means for adjusting to enable movement of the first scoring roll in the first lateral direction.

20. A scoring apparatus as recited in claim 17, wherein the second means for adjusting includes means for holding a position of the first scoring roll in the second lateral direction.

* * * * *